US010900630B2

(12) United States Patent
Dikau et al.

(10) Patent No.: US 10,900,630 B2
(45) Date of Patent: Jan. 26, 2021

(54) HEADLIGHT, IN PARTICULAR HEADLIGHT OF A MOTOR VEHICLE

(71) Applicant: HELLA GMBH & CO. KGAA, Lippstadt (DE)

(72) Inventors: Reinhard Dikau, Paderborn (DE); Susanne Hagedorn, Lippstadt (DE); Ronny Letzin, Lippstadt (DE); Matthias Mallon, Hamm (DE); Alfons Regenbrecht, Lippstadt (DE); Wilfried Richter, Lippstadt (DE); Daniel Suesselbeck, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 173 days.

(21) Appl. No.: 16/195,108

(22) Filed: Nov. 19, 2018

(65) Prior Publication Data

US 2019/0086050 A1 Mar. 21, 2019

Related U.S. Application Data

(63) Continuation of application No. PCT/EP2017/061204, filed on May 10, 2017.

(30) Foreign Application Priority Data

May 18, 2016 (DE) ..... 10 2016 109 132

(51) Int. Cl.
*F21S 41/24* (2018.01)
*F21S 41/32* (2018.01)
(Continued)

(52) U.S. Cl.
CPC ..... *F21S 41/24* (2018.01); *F21S 41/322* (2018.01); *F21S 41/143* (2018.01); *F21S 41/151* (2018.01);
(Continued)

(58) Field of Classification Search
CPC ..... F21S 41/24; F21S 41/151; F21S 41/322; F21S 41/143; F21W 2102/18; F21W 2102/14
See application file for complete search history.

(56) References Cited

U.S. PATENT DOCUMENTS 5,730,519 A * 3/1998 Okuchi ..... F21S 41/24 362/559
6,471,380 B1 * 10/2002 Henneboehle ..... F21S 43/26 362/498
(Continued)

FOREIGN PATENT DOCUMENTS

DE 102006044640 A1 3/2008
DE 102007052696 A1 7/2008
(Continued)

OTHER PUBLICATIONS

International Search Report dated Sep. 7, 2017 in corresponding application PCT/EP2017/061204.

*Primary Examiner* — Mary Ellen Bowman
(74) *Attorney, Agent, or Firm* — Muncy, Geissler, Olds & Lowe, P.C.

(57) ABSTRACT

A headlight, in particular a headlight of a motor vehicle, having at least one first light source for a high beam, which emits light during operation of the headlight, and a first light guide having at least one light entry surface for the light emerging from the at least one first light source and at least one light exit surface, and at least one second light source for a low beam, which emits light during operation of the headlight, and a second light guide, which has at least one light entry surface for the light, emerging from the at least one second light source, and at least one light exit surface.

19 Claims, 6 Drawing Sheets

(51) Int. Cl.

| | |
|---|---|
| ***F21S 41/143*** | (2018.01) |
| ***F21W 102/18*** | (2018.01) |
| ***F21S 41/151*** | (2018.01) |
| *F21W 102/14* | (2018.01) |

(52) U.S. Cl.
CPC ..... *F21W 2102/14* (2018.01); *F21W 2102/18* (2018.01)

(56) References Cited

U.S. PATENT DOCUMENTS

| | | | | |
|---|---|---|---|---|
| 7,156,544 | B2 | 1/2007 | Ishida | |
| 7,611,272 | B2 | 11/2009 | Specht et al. | |
| 8,801,242 | B2 | 8/2014 | Hamm et al. | |
| 9,108,563 | B2 * | 8/2015 | Tanaka | B60Q 1/04 |
| 9,157,595 | B2 | 10/2015 | Hager et al. | |
| 9,599,301 | B2 | 3/2017 | Brendle | |
| 9,611,997 | B2 * | 4/2017 | Bauer | F21S 41/148 |
| 10,054,279 | B2 | 8/2018 | Kliebisch | |
| 2005/0068787 | A1 * | 3/2005 | Ishida | F21S 41/663 362/538 |
| 2008/0080201 | A1 * | 4/2008 | Specht | F21S 41/43 362/507 |
| 2010/0033978 | A1 * | 2/2010 | Ehm | B60Q 1/085 362/465 |
| 2012/0275173 | A1 * | 11/2012 | Hamm | F21S 41/143 362/487 |

FOREIGN PATENT DOCUMENTS

| | | | |
|---|---|---|---|
| DE | 102011077636 | A1 | 11/2011 |
| DE | 102010041096 | A1 | 3/2012 |
| DE | 102012010659 | A1 | 11/2012 |
| DE | 102012218684 | A1 | 4/2014 |
| DE | 102015104514 | A1 | 9/2016 |
| EP | 1903274 | A1 | 3/2008 |
| FR | 2860280 | A1 | 4/2005 |

* cited by examiner

HEADLIGHT, IN PARTICULAR HEADLIGHT OF A MOTOR VEHICLE

This nonprovisional application is a continuation of International Application No. PCT/EP2017/061204, which was filed on May 10, 2017, and which claims priority to German Patent Application No. 10 2016 109 132.4, which was filed in Germany on May 18, 2016, and which are both herein incorporated by reference.

BACKGROUND OF THE INVENTION

Field of the Invention

The present invention relates to a headlight, in particular a headlight of a motor vehicle.

Description of the Background Art

A headlight is known from DE 10 2010 041 096 A1, which corresponds to U.S. Pat. No. 9,157,595. The headlight described therein comprises a shared circuit board for a plurality of light-emitting diodes (LEDs), which serve to generate the high beam and low beam. The light exits upwards from these light-emitting diodes. In this case, a light conducting element is provided for the high beam, in which element the light is coupled by part of the light-emitting diodes and deflected forward. Furthermore, a reflector arranged above the light conducting element is provided, which reflects the light of part of the light-emitting diodes forward, which contribute to the low beam. Both the light reflected by the reflector and the light emerging from the light conducting elements pass through a shared lens and forwards out of the headlight.

The provision of a reflector for the low beam is disadvantageous in this prior art, because, on the one hand, it has a relatively expensive design and, on the other, it has relatively large dimensions.

SUMMARY OF THE INVENTION

It is therefore an object of the present invention to provide a headlight, which is designed more cost-effectively and/or more compact.

In an exemplary embodiment, a headlight is provided that comprises a second light guide, which has at least one light entry surface for the light, emerging from the at least one second light source, and at least one light exit surface. The use of the light guide instead of a reflector for the low beam allows a more compact headlight design. Furthermore, the cost of the headlight can be reduced because the light guides can be produced more easily. In particular, the light guides can consist of glass or plastic, for example, of PC or PMMA.

It can be provided that the light sources are arranged on a mutual holder, wherein the light sources are in particular formed as light-emitting diodes and are preferably arranged on a shared circuit board. This measure also helps to make the headlight compact.

There is the possibility that the at least one light exit surface of the second light guide has a structuring which homogenizes the exiting light. As a result, in particular unwanted local intensity maxima on a lens, located behind the light guide, and/or a cover lens of the headlight are prevented.

It can be provided that the first light guide is more extended in the light propagation direction than the second light guide. It can be provided further that the first light guide has a surface which is formed to be at least sectionally reflective, and in particular is provided with a reflective coating. In this case, the surface, formed at least sectionally reflective, can be located in the first light guide section that projects beyond the second light guide in the light propagation direction, so that the light emerging from the second light guide is reflected at least partially on the surface formed at least sectionally reflective. It is prevented in this way, on the one hand, that uncontrolled light out of the light guide provided for the low beam enters the light guide provided for the high beam and causes scattered light or glare. On the other hand, the efficiency of the headlight is increased because the reflected portion of the light can continue to be used for the low beam.

There is the possibility that the reflective region of the surface, formed at least sectionally reflective, does not extend to the edge of the light exit surface of the first light guide, and in particular has a distance between 0.3 mm and 5.0 mm, preferably a distance between 0.5 mm and 3.0 mm, for example, a distance of about 1.0 mm from the edge of the light exit surface. Because the region, directly adjacent to the edge, of the surface, formed at least sectionally reflective, does not contribute to the reflection, the cut-off line of the low beam is softened.

It can be provided that the at least one light exit surface of the first light guide is curved. In this way, a field curvature can be counteracted. Furthermore, the curvature can also be used to correct the cut-off line of the low beam.

There is a possibility that the headlight is designed such that part of the light emerging from the second light guide enters the first light guide, so as to generate a portion of light that enters a region located above the region illuminated by the low beam. This portion of light is located above the cut-off line of the low beam and serves to illuminate overhead signs, as they are common especially on highways.

It can be provided that the first light guide for the entry of the light emerging from the second light guide has a light entry region, in particular in the surface, formed at least sectionally reflective, wherein the light entry region is realized, for example, by a step, preferably a prism step. In this way, a corresponding light component can be created with very simple means.

There is the possibility that the first light guide and the second light guide are arranged adjacent to one another, in particular abut one another at least in sections. This also contributes to the compactness of the headlight.

It can be provided that the first and/or second light guide comprises one or more positioners which predetermine(s) the arrangement of the light guides to one another, wherein in particular the light guides partially engage one another or are inserted into one another, so that the distance between the first and second light guides is predetermined by the connection of the light guides. A relatively exact positioning of the two light guides relative to one another can be realized with the positioner; this is particularly advantageous because of the at least partially reflective surface and the selective coupling of a portion of the low beam into the light guide of the high beam.

It is possible that the headlight comprises a device for generating a vertical cut-off line. A vertical cut-off line is used in particular when a part of the high beam is to be dimmed, for example, because of oncoming traffic.

It can be provided that the headlight for generating the vertical cut-off line comprises two first light guides, in particular wherein the light sources assigned to the two first light guides can be controlled separately, or that the headlight for generating the vertical cut-off line has an at least partially opaque coating on a section of the light exit surface of the first light guide.

In the variant with the two first light guides, for example, the light sources assigned to one of the two first light guides can be switched off selectively, so that a vertical cut-off line is generated.

The variant with the at least partially opaque coating on a section of the light exit surface of the first light guide is a cost-effective embodiment. A complete high beam distribution is achieved in this embodiment only by adding a headlight formed mirror-inverted and to be placed on the other side of the vehicle. The vertical cut-off line can be achieved in this embodiment by pivoting apart of the left and right headlights.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

The illustrated embodiment of a headlight of the invention comprises a circuit board on which a plurality of light sources formed as light-emitting diodes (LED) are located. In this case, both a plurality of first light sources formed as light-emitting diodes for a high beam and a plurality of second light sources formed as light-emitting diodes for a low beam are arranged on the circuit board.

It is possible to use other light sources instead of the light-emitting diodes. For example, semiconductor lasers could also be provided as light sources.

The light sources can be controlled separately to switch between low and high beams. It is also possible to realize other functions of an adaptive front light system by different energization of the light sources, such as, for example, city lights, country lights, or highway lights. There is also the possibility of switching to a mono function.

Figure 1:
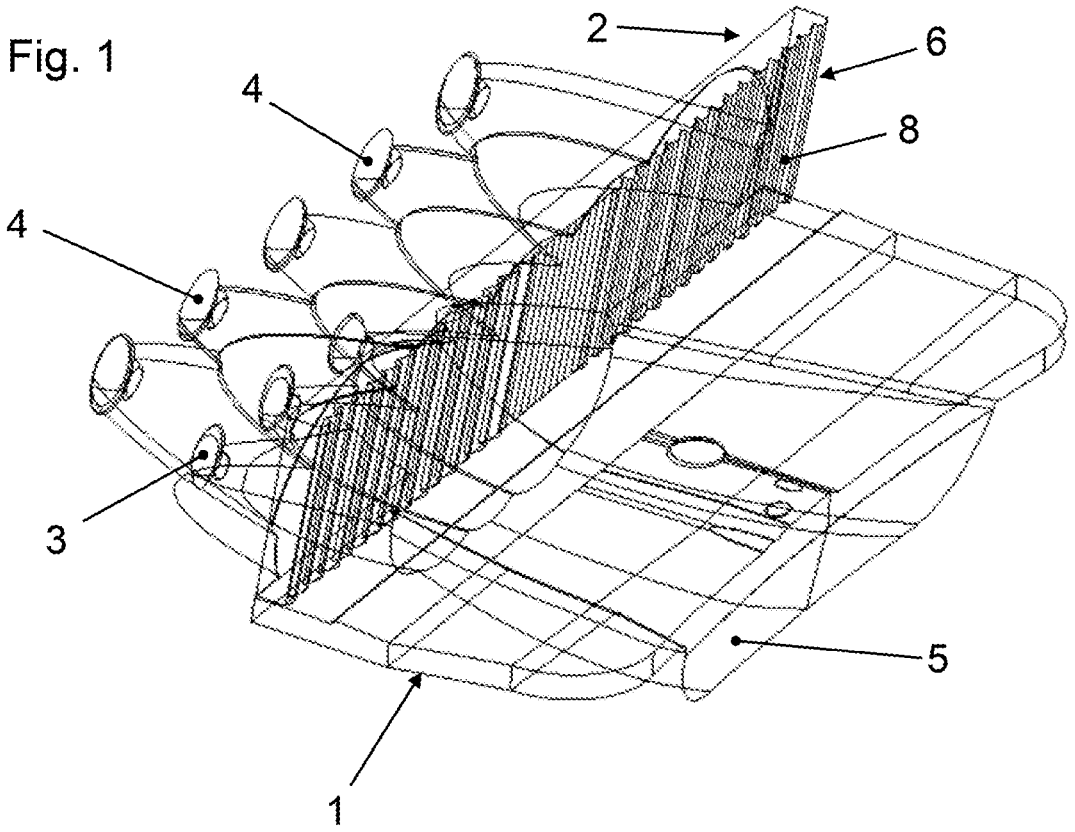
FIG. 1 shows a schematic perspective view of an embodiment of light guides of a headlight of the invention.
Figure 2:
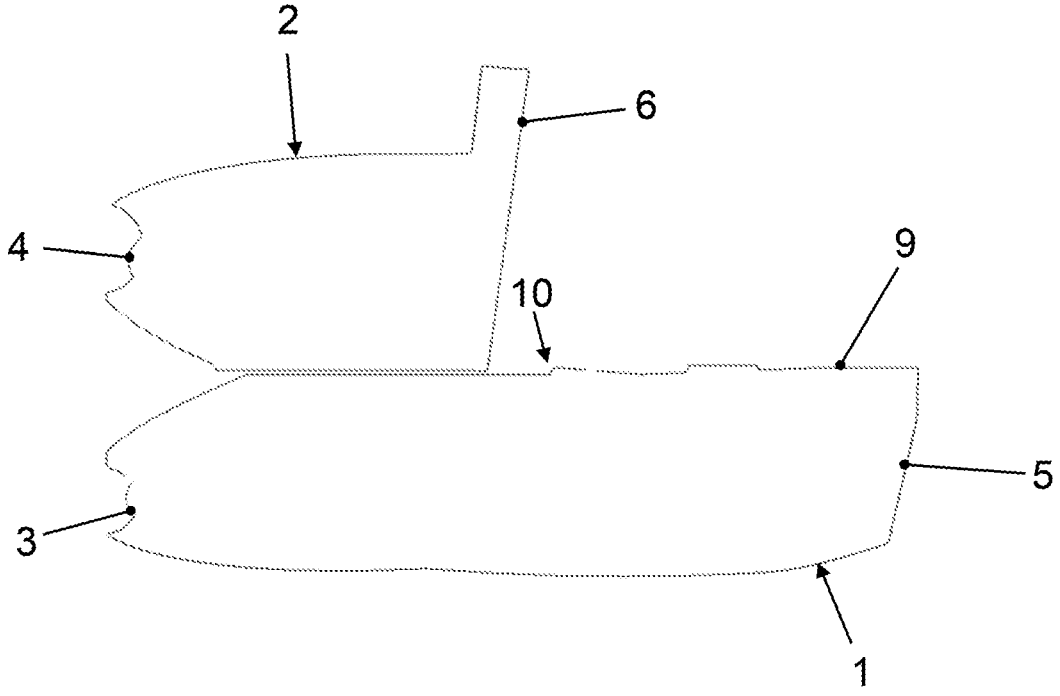
FIG. 2 shows a schematic side view of the light guides of FIG. 1.

The illustrated embodiment of a headlight of the invention further comprises a first light guide 1 for the high beam and a second light guide 2 for the low beam (see, for example, FIG. 2). Light guides 1, 2 each have a plurality of light entry surfaces 3, 4 on their left-hand side in FIG. 2 (also see FIG. 1), into which the light of the light-emitting diodes is coupled during headlight operation. On the right-hand side in FIG. 2, light guides 1, 2 each have a light exit surface 5, 6 through which the light exits.

Figure 5:
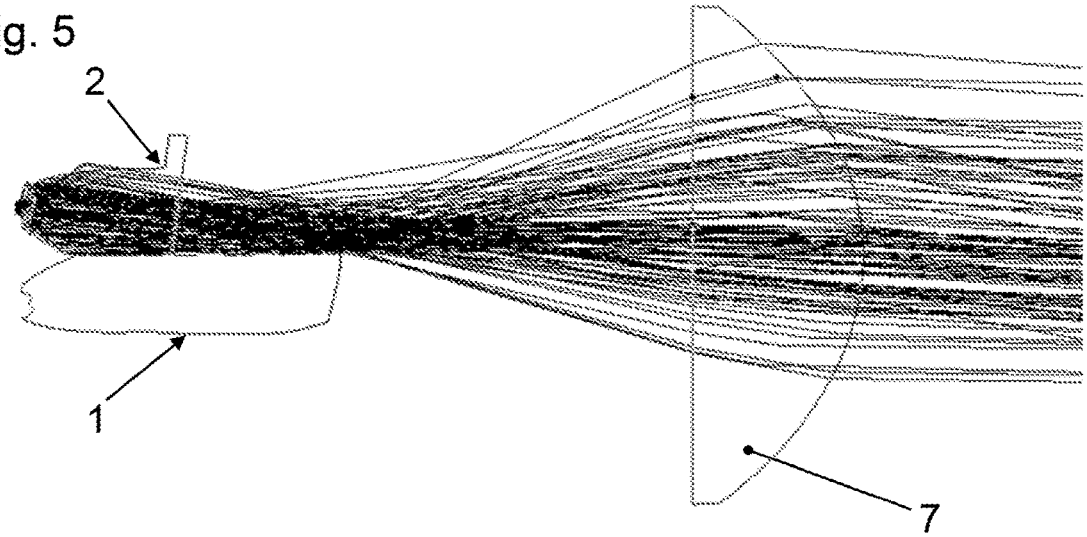
FIG. 5 shows a beam path corresponding to a low beam light through the light guides of FIG. 1 and a lens, arranged behind them, of a headlight of the invention.
Figure 6:
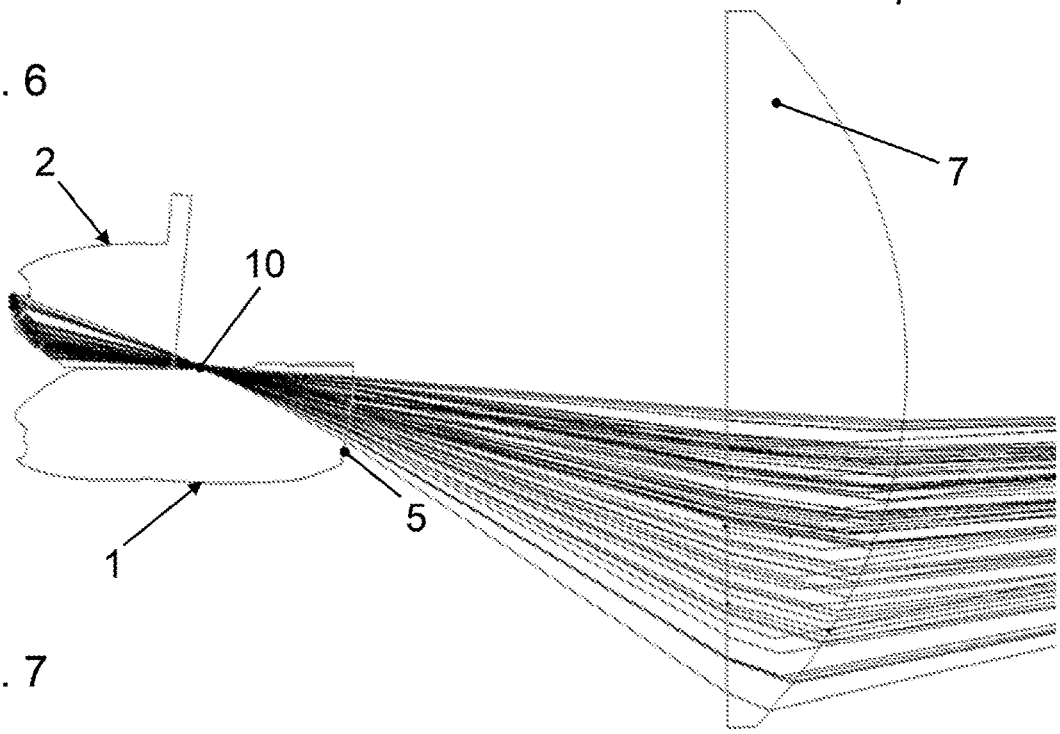
FIG. 6 shows a beam path through the light guides of FIG. 1 and a lens, arranged behind them, of a headlight of the invention, in which a part of the light emerging from the second light guide passes through the first light guide.

The illustrated embodiment of a headlight of the invention further comprises a lens 7, which is arranged in the light propagation direction behind light exit surfaces 5, 6 of light guides 1, 2 (see FIG. 5 and FIG. 6). In the illustrated embodiment, lens 7 is formed as a plano-convex lens. There is also the possibility to provide other designs for lens 7. The input-side focal plane of lens 7 is located approximately in the region of light exit surface 5 of first light guide 1.

The illustrated embodiment of a headlight of the invention further comprises a housing in or on which light guides 1, 2 with the circuit board, lens 7, and also heat sinks for the light-emitting diodes arranged on the circuit board can be attached.

Figure 3:
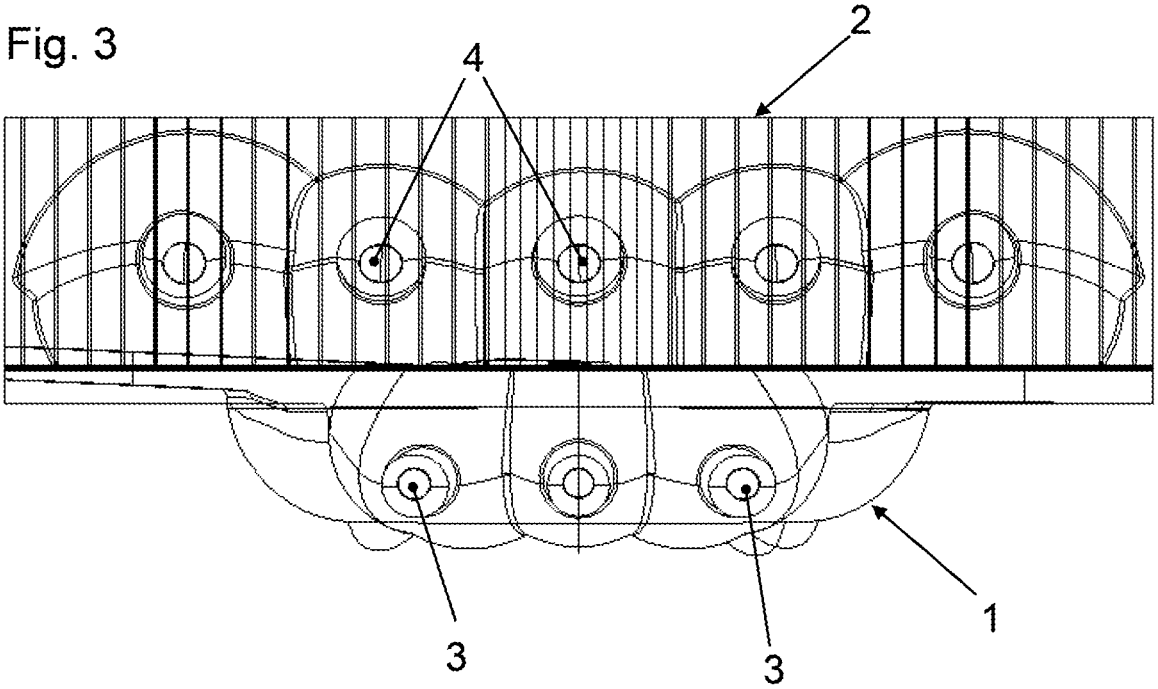
FIG. 3 shows a schematic view from the rear of the light guides of FIG. 1.

FIG. 3 illustrates that three light entry surfaces 3 of first light guide 1 and five light entry surfaces 4 of second light guide 2 are provided. If, a light source, for example, formed as a light-emitting diode, is arranged in front of each light entry surface 3, 4, three light sources would be provided for the high beam and five light sources for the low beam.

However, in particular due to the shape and size of light entry surfaces 3, 4, it is also certainly possible to arrange more than one light source, for example, formed as a light-emitting diode, in front of each light entry surface 3, 4, so that correspondingly more light sources can be provided for the high beam and/or the low beam.

There is also the possibility of arranging more or fewer light entry surfaces 3, 4 on both first light guide 1 and second light guide 2.

Figure 4:
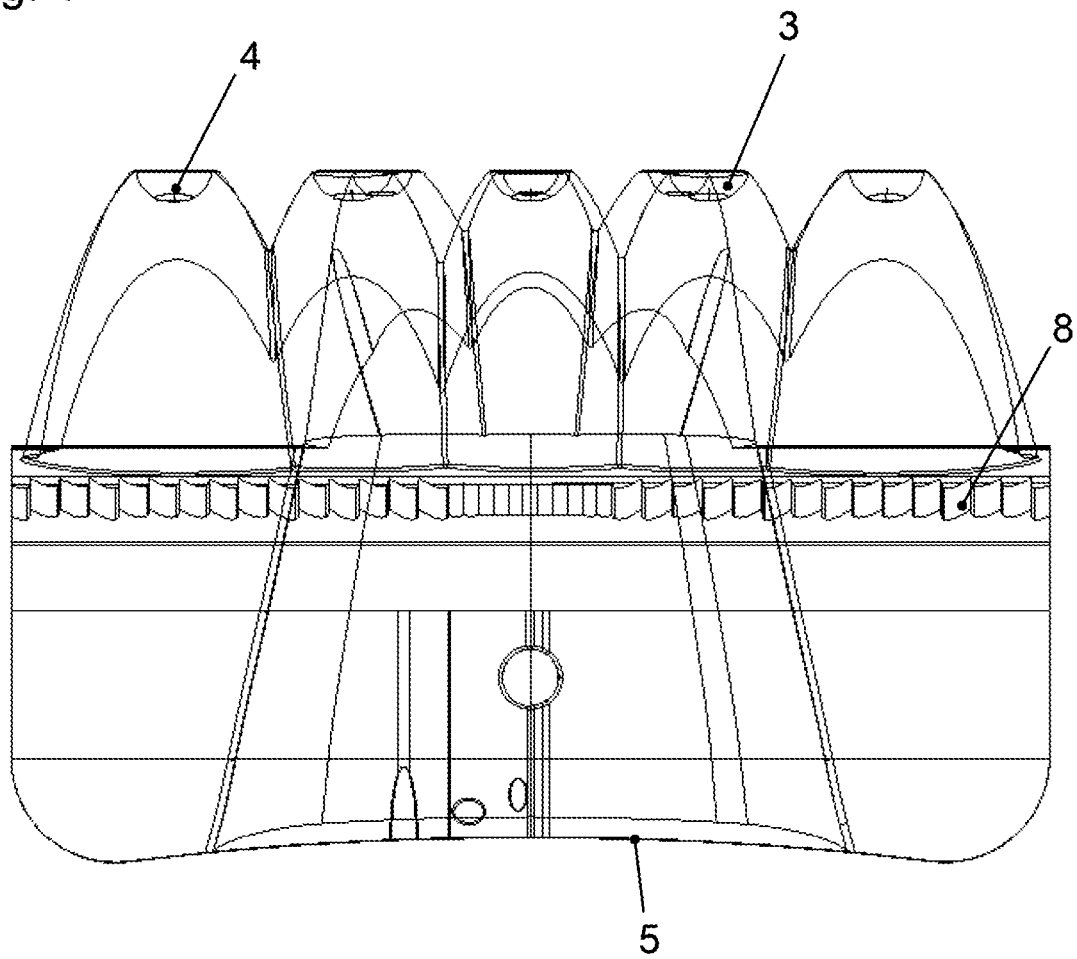
FIG. 4 shows a schematic top plan view of the light guides of FIG. 1.

FIGS. 1 and 4 illustrate that light exit surface 6 of second light guide 2 has a structuring 8, which in the illustrated embodiment is formed as a prism array. As a result of the structuring 8, the light emerging from light exit surface 6 is homogenized at least to the extent that no unwanted intensity maxima arise on lens 7 and a cover lens.

FIG. 1 further shows that light exit surface 5 of first light guide 1 is curved. This achieves a correction of the field curvature of the high beam.

Second light guide 2 is shorter in the light propagation direction than first light guide 1 (see, for example, FIG. 2), so that the light emerging from light exit surface 6 of second light guide 2 exits above first light guide 1. Upper surface 9 of first light guide 1 is formed at least partially reflective in the region between light exit surface 6 of second light guide 2 and light exit surface 5 of first light guide 1. This is achieved in particular by a reflective coating of the corresponding sections of upper surface 9.

The reflective region of upper surface 9 reflects part of the light emerging from light exit surface 6 of second light guide 2 (see FIG. 5), so that this light does not enter first light guide 1 of the high beam in an uncontrolled manner, which could result in blinding of oncoming traffic in low beam operation.

The reflective region of upper surface 9 does not extend completely to the edge of light exit surface 5 but ends shortly before it, for example, about 1 mm in front of the edge. This has the result that the cut-off line of the low beam is not abrupt but slightly softened.

The at least partially reflective upper surface 9 of first light guide 1 has in its front region, on the left in FIG. 2, a light entry region 10 which in the illustrated embodiment is formed as a prism step, not provided with a reflective coating, in upper surface 9 (see FIG. 2). The prism step forming light entry region 10 can extend, for example, into a central region over approximately half of upper surface 9 in the transverse direction of first light guide 1. However, there is certainly also the possibility of forming the step shorter or longer, for example, over the entire width of upper surface 9.

FIG. 6 illustrates how a part of the light emerging from second light guide 2 enters first light guide 1 through light entry region 10 and exits forward from its light exit surface 5 and passes through lens 7. This part of the light is deflected upward by lens 7, so that it reaches a region above the cut-off line of the low beam.

Figure 7:
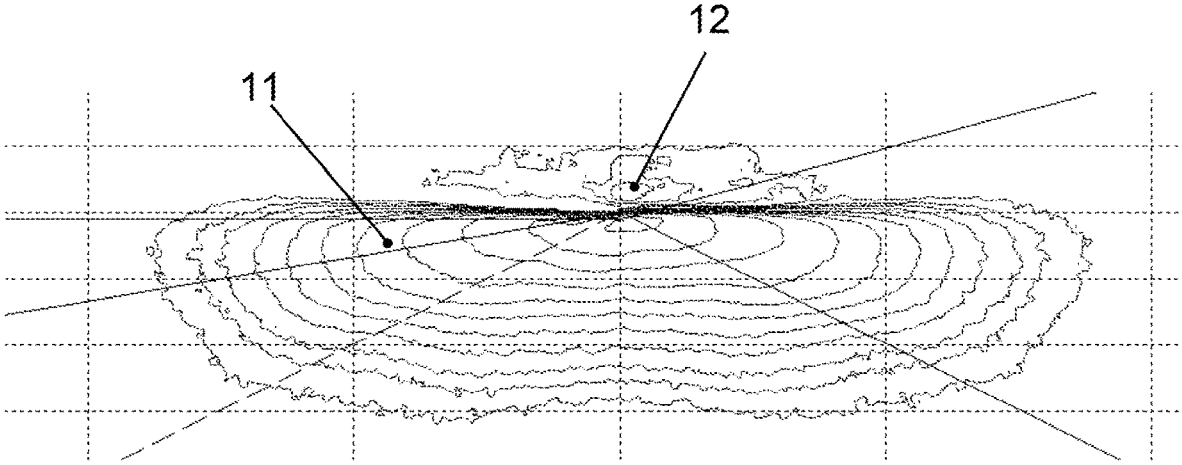
FIG. 7 shows a light distribution corresponding to the two beam paths in FIG. 5 and FIG. 6.

FIG. 7 illustrates in a light distribution, on the one hand, low beam 11 and, on the other hand, the portion 12 of the light that has entered first light guide 1 through light entry region 10. As can be seen, this portion 12 is arranged above the cut-off line. Portion 12 serves to illuminate overhead signs, as they are common in particular on highways. Such an illumination of objects located above the street by a headlight is also called the OS function (overhead sign function).

Due to the fact that the two light guides 1, 2 work together due to the at least partially reflective surface 9 and light entry region 10 in part to generate a light distribution, the most accurate possible positioning of the two light guides 1, 2 to one another is expedient. FIGS. 10 to 15 illustrate this positioning.

Figure 10:
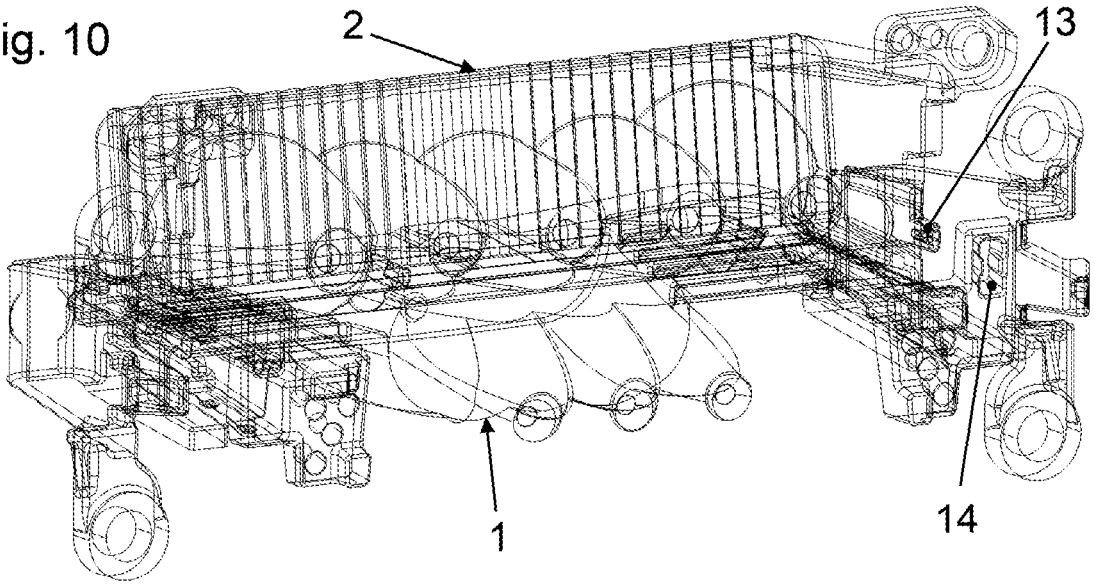
FIG. 10 shows a schematic perspective view of the light guides of FIG. 1 before the connection of the two light guides.
Figure 11:
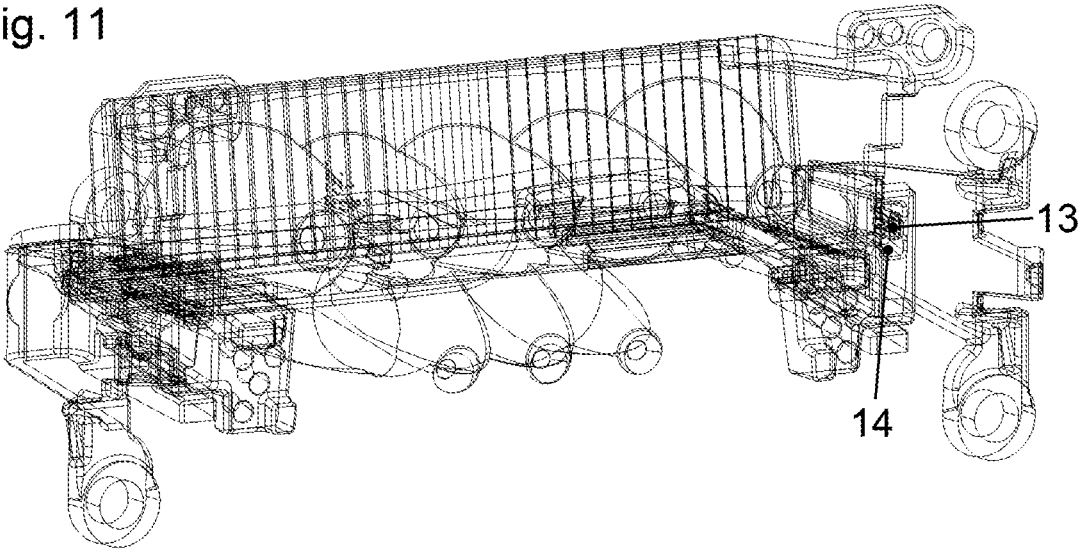
FIG. 11 shows a view corresponding to FIG. 10 after connection of the two light guides.
Figure 12:
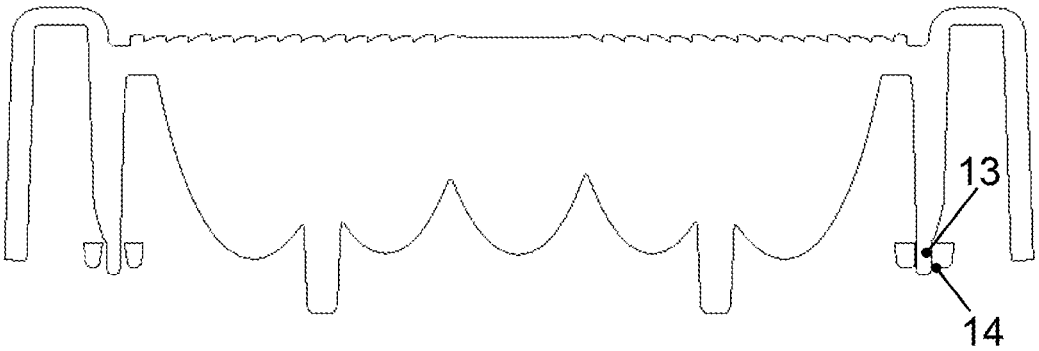
FIG. 12 shows a section transverse to the light propagation direction through the two light guides in the interconnected state according to FIG. 11.

FIG. 10 shows a pin 13 on second light guide 2 and a matching opening 14 on first light guide 1. As a result of the insertion of pin 13 into opening 14 as is evident in FIGS. 11 and 12, light guides 1, 2 are positioned relative to one another in the transverse direction of the headlight or the direction which extends from left to right in FIG. 12.

Figure 13:
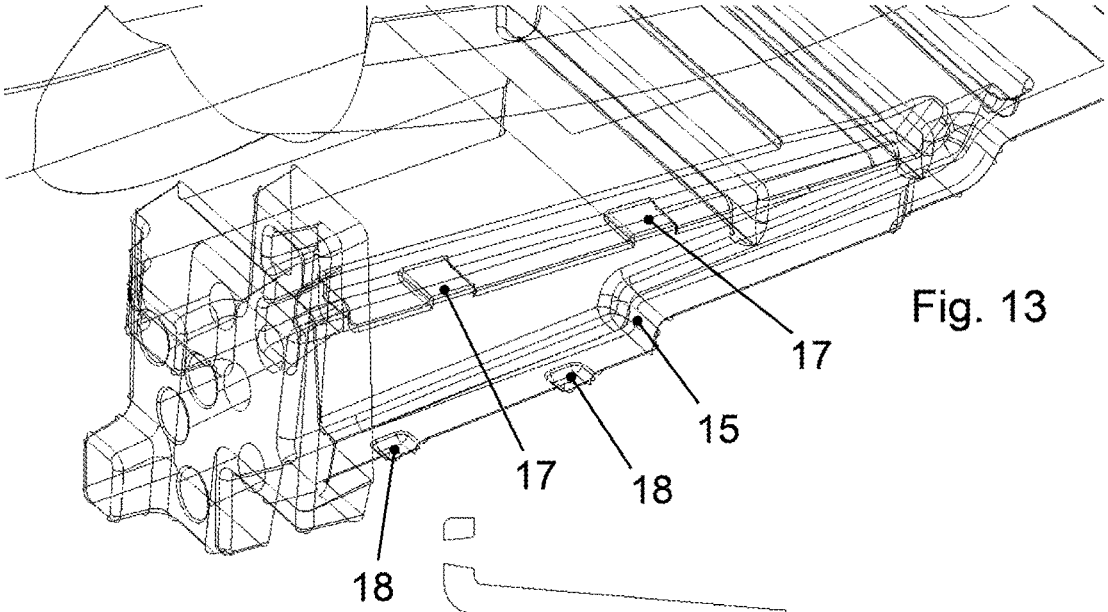
FIG. 13 shows a schematic perspective detail view of the light guides of FIG. 1 before connection of the two light guides.
Figure 14:
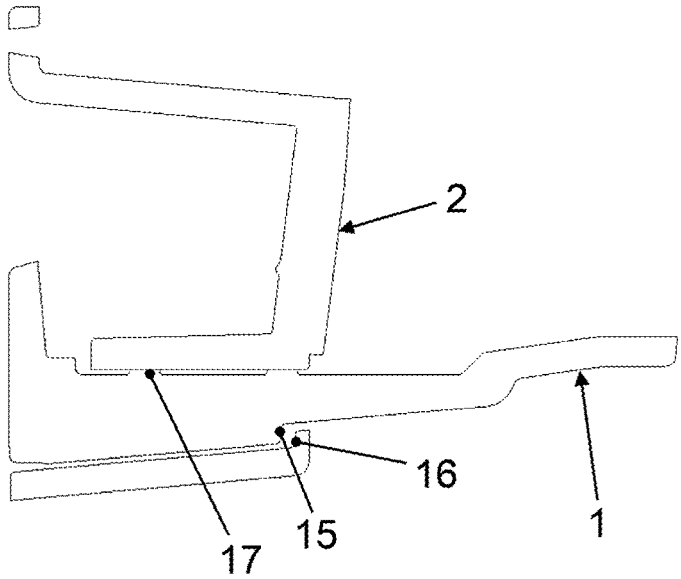
FIG. 14 shows a section in the light propagation direction through the two light guides in the interconnected state according to FIG. 11.
Figure 15:
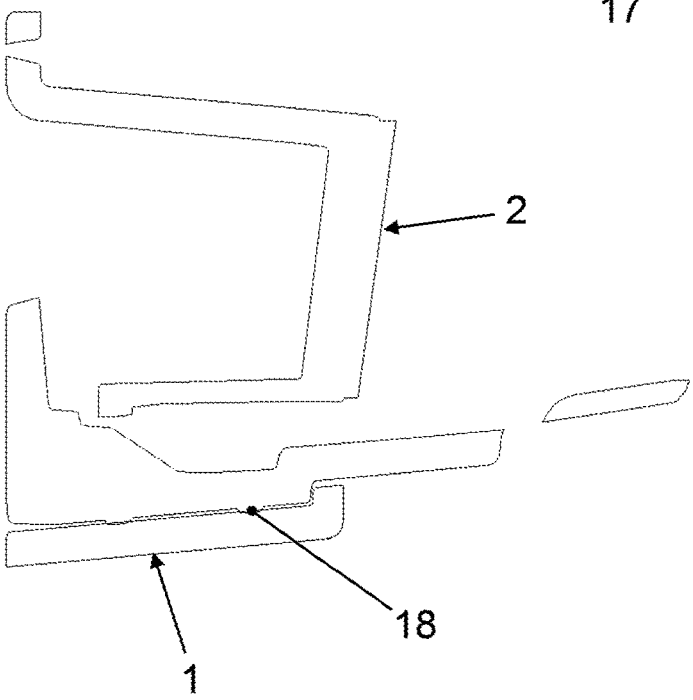
FIG. 15 shows a section, offset transversely compared with FIG. 14, in the light propagation direction through the two light guides in the interconnected state according to FIG. 11.

FIGS. 13 and 14 show a shoulder 15 of first light guide 1 which acts together with a shoulder 16 of second light guide 2 in order to position light guides 1, 2 in the light propagation direction relative to one another. In particular, at the end of a sliding operation, in which first light guide 1 is partially inserted into partial regions of second light guide 2, the two shoulders 15, 16 abut one another.

FIGS. 13 and 14 furthermore show projections 17, which are located on first light guide 1, project upwards from it, and, in the connected state of the two light guides 1, 2, abut the underside of a section of second light guide 2. In this case, projections 18 located in a different transverse plane on first light guide 1 and projecting downward from it rest on another section of second light guide 2. The abutment of projections 17, 18 on second light guide 2 ensures the desired positioning in the vertical direction of the headlight.

Figure 8:
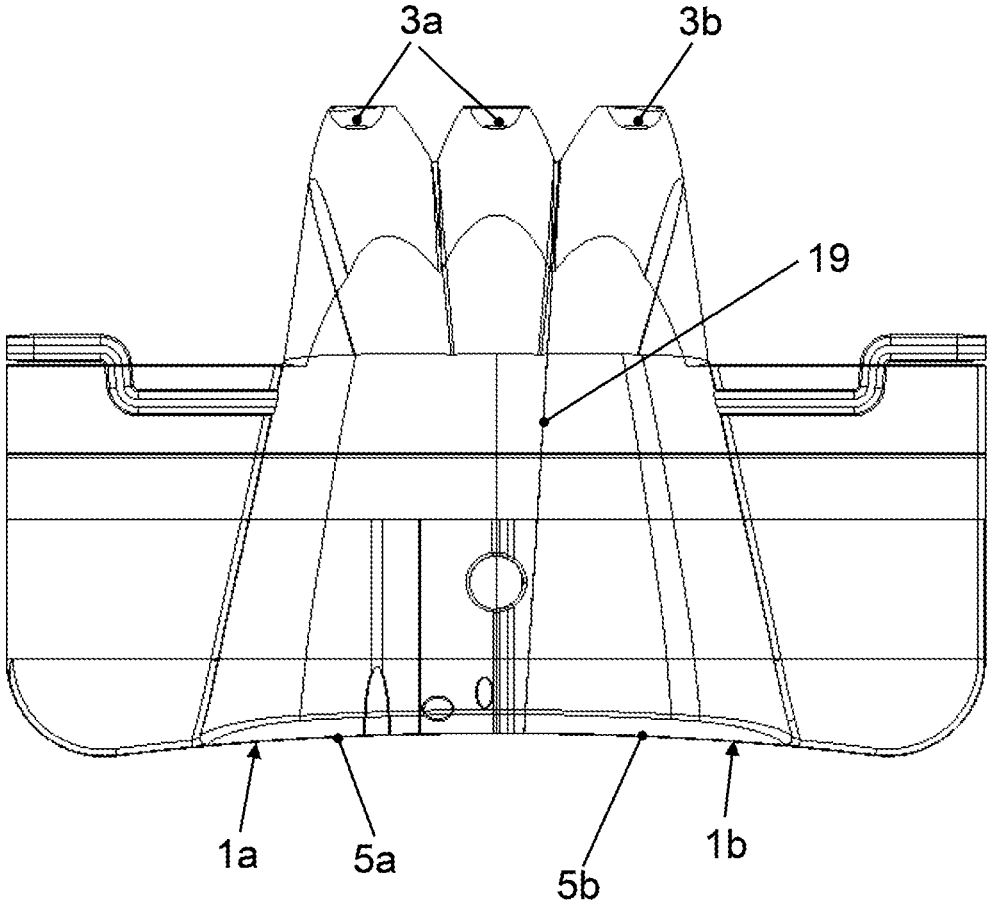
FIG. 8 shows a schematic top plan view of an embodiment of light guides of a headlight of the invention.
Figure 9:
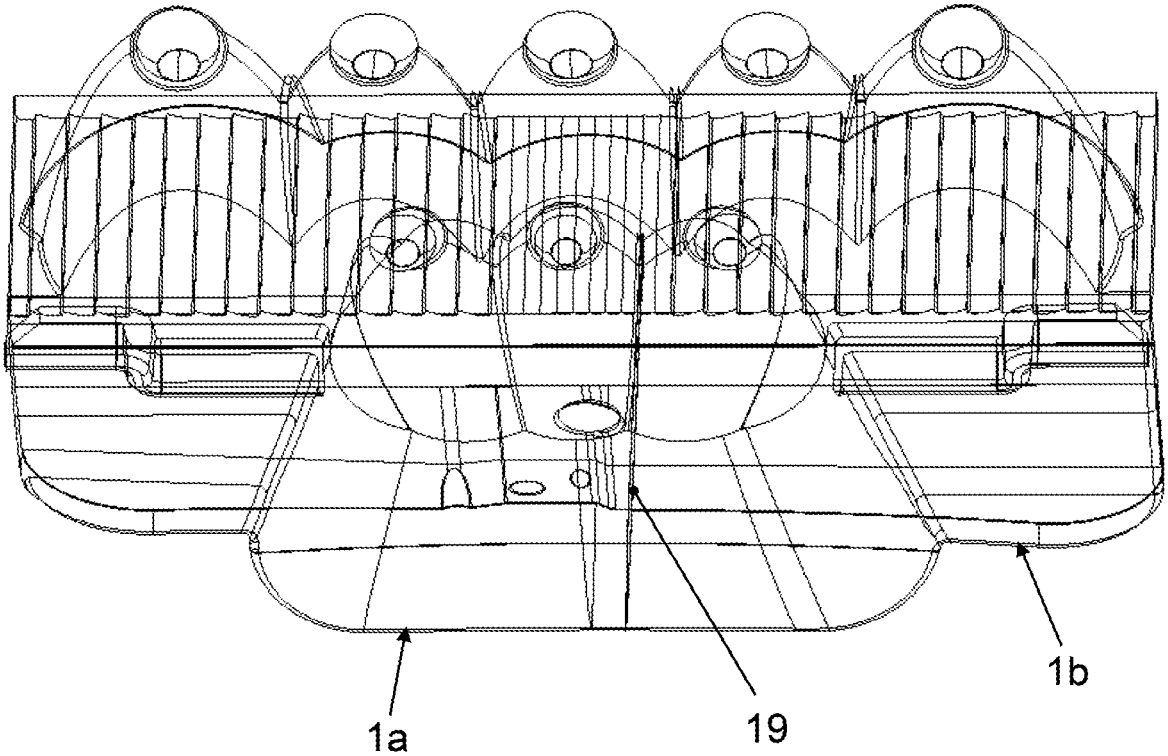
FIG. 9 shows a schematic perspective view of the light guides of FIG. 8.

The second embodiment shown in FIGS. 8 and 9 differs from the first embodiment according to FIGS. 1 to 6 in the design of the first light guide. In the embodiment according to FIG. 8 and FIG. 9, two first light guides 1*a*, 1*b* are provided, which together approximately correspond to first light guide 1 of the first embodiment.

FIG. 8 and FIG. 9 show a separating surface 19 between the two first light guides 1*a*, 1*b*. It can be seen that two light entry surfaces 3*a* are assigned to the left light guide 1*a* in FIG. 8 and only one light entry surface 3*b* to the right light guide 1*b* in FIG. 8. Accordingly, the light coupled into the two left light entry surfaces 3*a* emerges from light exit surface 5*a* of left light guide 1*a* in FIG. 8, whereas the light coupled into right light entry surface 3*b* exits light exit surface 5*b* of right light guide 1*b* in FIG. 8.

Due to the separate controllability of the light sources assigned to the two first light guides 1*a*, 1*b*, the light sources assigned to one of the two light guides 1*a*, 1*b* can be switched off selectively and the left and right headlights can be pivoted apart, for example, if an oncoming vehicle was detected, which is not to be blinded. A vertical cut-off line can be created in this way.

It can be provided to make separating surface 19 opaque to the light emerging from the light sources, for example, by a suitable coating, so that unwanted crossing of the light from one of the two light guides 1*a*, 1*b* to the other is prevented.

It is possible to design a headlight, to be placed on the other side of the vehicle, mirror-inverted to the embodiment shown in FIGS. 8 and 9, so that both headlights contribute in the same way to the vertical cut-off.

In a cost-effective embodiment, the light sources, for example, of right light entry surface 3*b* in FIG. 8 can be omitted. In particular, right light exit surface 5*b* can then be provided with an opaque coating, so that the single headlight generates an incomplete high beam distribution. A complete high beam distribution is achieved in this embodiment only by adding a headlight formed mirror-inverted and to be placed on the other side of the vehicle. The aforementioned vertical cut-off line can be achieved in this embodiment by the pivoting apart of the left and right headlights.

The invention being thus described, it will be obvious that the same may be varied in many ways. Such variations are not to be regarded as a departure from the spirit and scope of the invention, and all such modifications as would be obvious to one skilled in the art are to be included within the scope of the following claims

What is claimed is:

1. A headlight comprising:

at least one first light source for a high beam, which emits light during operation of the headlight;

a first light guide having at least one light entry surface for the light emerging from the at least one first light source and having at least one light exit surface;

at least one second light source for a low beam, which emits light during operation of the headlight; and a second light guide, which has at least one light entry surface for the light emerging from the at least one second light source and having at least one light exit surface, wherein the headlight is designed such that part of the light emerging from the second light guide enters the first light guide so as to generate a portion of light that enters a region located above the region illuminated by the low beam.

2. The headlight according to claim 1, wherein the at least one first light source and the at least one second light source are arranged on a mutual holder, wherein the at least one first light source and the at least one second light source are formed as light-emitting diodes and are arranged on a shared circuit board.

3. The headlight according to claim 1, wherein the at least one light exit surface of the second light guide has a structuring that homogenizes the exiting light.

4. The headlight according to claim 1, wherein the first light guide is more extended in the light propagation direction than the second light guide, such that a section of the first light guide projects beyond the second light guide in the light propagation direction.

5. The headlight according to claim 4, wherein the first light guide has a surface which is formed to be at least sectionally reflective and is provided with a reflective coating to form a reflection region.

6. The headlight according to claim 5, wherein the surface, formed at least sectionally reflective, is located in the section of the first light guide which projects beyond the second light guide in the light propagation direction, so that the light emerging from the second light guide is reflected at least partially on the surface formed at least sectionally reflective.

7. A headlight comprising:

at least one first light source for a high beam, which emits light during operation of the headlight;

a first light guide having at least one light entry surface for the light emerging from the at least one first light source and having at least one light exit surface;

at least one second light source for a low beam, which emits light during operation of the headlight; and a second light guide, which has at least one light entry surface for the light emerging from the at least one second light source and having at least one light exit surface, wherein the first light guide is more extended in the light propagation direction than the second light guide, such that a section of the first light guide projects beyond the second light guide in the light propagation direction, wherein the first light guide has a surface which is formed to be at least sectionally reflective and is provided with a reflective coating to form a reflection region, and wherein the reflective region of the surface formed at least sectionally reflective does not extend to the edge of the light exit surface of the first light guide, and has a distance between 0.3 mm and 5.0 mm to the edge of the light exit surface.

8. The headlight according to claim 1, wherein the at least one light exit surface of the first light guide is curved.

9. The headlight according to claim 1, wherein the first light guide has a light entry region for the entry of light emerging from the second light guide, the light entry region being in a surface formed at least sectionally reflective, wherein the light entry region is realized by a step.

10. The headlight according to claim 1, wherein the first light guide and the second light guide are arranged adjacent to one another or abut one another at least in sections.

11. The headlight according to claim 1, wherein the first and/or second light guide comprises a positioner which predetermines the arrangement of the first light guide and the second light guide to one another, wherein the first light guide and the second light guide partially engage one another or are inserted into one another so that the distance between the first light guide and the second light guide is predetermined by the connection of the first light guide and the second light guide.

12. The headlight according to claim 1, further comprising a device for generating a vertical cut-off line.

13. The headlight according to claim 12, wherein the device for generating the vertical cut-off line comprises two of the first light guide, such that two first light guides are provided, wherein the light sources assigned to the two first light guides are controllable separately, or wherein the device for generating the vertical cut-off line has an at least partially opaque coating on a section of the light exit surface of the first light guide.

14. The headlight according to claim 1, further comprising a lens through which the light emerging from the light exit surface of the first light guide and/or the light exit surface of the second light guide passes during operation of the headlight.

15. The headlight according to claim 1, wherein the headlight is a motor vehicle headlight.

16. The headlight according to claim 7, wherein the reflective region of the surface formed at least sectionally reflective has a distance between 0.5 mm and 3.0 mm to the edge of the light exit surface.

17. The headlight according to claim 7, wherein the reflective region of the surface formed at least sectionally reflective has a distance of about 1.0 mm to the edge of the light exit surface.

18. The headlight according to claim 3, wherein the structuring is a prism array.

19. The headlight according to claim 12, wherein the device for generating the vertical cut-off line comprises two of the first light guide, such that two first light guides are provided, and wherein the light sources assigned to the two first light guides are controllable separately.

* * * * *